US008789660B2

(12) United States Patent
Tenhunen

(10) Patent No.: US 8,789,660 B2
(45) Date of Patent: Jul. 29, 2014

(54) ELEVATOR SYSTEM USING A MOVEMENT PROFILE

(71) Applicant: Kone Corporation, Helsinki (FI)

(72) Inventor: Asmo Tenhunen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/652,157

(22) Filed: Oct. 15, 2012

(65) Prior Publication Data

US 2013/0075200 A1 Mar. 28, 2013

Related U.S. Application Data

(63) Continuation of application No. PCT/FI2011/000021, filed on Apr. 13, 2011.

(30) Foreign Application Priority Data

Apr. 16, 2010 (FI) ..... 20105401

(51) Int. Cl.
*B66B 1/28* (2006.01)

(52) U.S. Cl.
USPC ..... 187/295; 187/393

(58) Field of Classification Search
USPC ..... 187/247, 290, 291, 293, 295–297, 187/391–393; 318/362, 799–815
See application file for complete search history.

(56) References Cited

U.S. PATENT DOCUMENTS

| | | | | |
|---|---|---|---|---|
| 4,553,640 | A * | 11/1985 | Inaba et al. | 187/292 |
| 4,751,984 | A * | 6/1988 | Williams et al. | 187/293 |
| 5,035,301 | A | 7/1991 | Skalski | |
| 5,241,141 | A * | 8/1993 | Cominelli | 187/295 |
| 5,612,517 | A * | 3/1997 | Johansson | 187/285 |
| 6,202,796 | B1 * | 3/2001 | Lee | 187/293 |
| 6,311,802 | B1 * | 11/2001 | Choi et al. | 187/293 |
| 7,533,763 | B2 * | 5/2009 | Kattainen et al. | 187/394 |
| 7,575,100 | B2 * | 8/2009 | Kugiya et al. | 187/305 |
| 7,740,112 | B2 * | 6/2010 | Iwata et al. | 187/393 |
| 7,921,969 | B2 * | 4/2011 | Stolt et al. | 187/391 |
| 8,439,168 | B2 * | 5/2013 | Kondo et al. | 187/295 |
| 8,459,415 | B2 * | 6/2013 | Kwon et al. | 187/295 |
| 2001/0017239 | A1 | 8/2001 | Tajima et al. | |
| 2003/0127289 | A1 * | 7/2003 | Elgas et al. | 187/224 |
| 2006/0124399 | A1 | 6/2006 | Kugiya et al. | |
| 2010/0126809 | A1 | 5/2010 | Foschini et al. | |
| 2013/0075199 | A1 * | 3/2013 | Kauppinen et al. | 187/247 |

FOREIGN PATENT DOCUMENTS

| | | | |
|---|---|---|---|
| CN | 1861508 | A | 11/2006 |
| CN | 101044079 | A | 9/2007 |
| EP | 1 721 855 | A2 | 11/2006 |
| JP | 54-75739 | A | 6/1979 |
| JP | 5-201632 | A | 8/1993 |
| JP | 2001-26380 | A | 1/2001 |
| WO | WO 2006/043926 | A1 | 4/2006 |

* cited by examiner

*Primary Examiner* — Anthony Salata
(74) *Attorney, Agent, or Firm* — Birch, Stewart, Kolasch & Birch, LLP

(57) ABSTRACT

An elevator system includes an elevator car and also a motor drive for moving the elevator car according to a movement profile to be determined for the movement of the elevator car. The loading of the motor drive is arranged to be limited to the limit value for the maximum permitted loading by changing the value of a movement magnitude of the elevator car in the movement profile of the elevator car when the position of the elevator car changes.

18 Claims, 4 Drawing Sheets

ELEVATOR SYSTEM USING A MOVEMENT PROFILE

CROSS REFERENCE TO RELATED APPLICATIONS

This application is a Continuation of PCT International Application No. PCT/FI2011/000021 filed on Apr. 13, 2011, which claims priority under 35 U.S.C. §119(a) to Patent Application No. 20105401 filed in Finland on Apr. 16, 2010, all of which are hereby expressly incorporated by reference into the present application.

FIELD OF THE INVENTION

The invention relates to solutions for preventing the overloading of a motor drive of an elevator system.

BACKGROUND OF THE INVENTION

An elevator system comprises a motor drive for moving an elevator car. The motor drive usually comprises a hoisting machine of the elevator and also a power supply apparatus, such as a frequency converter, of the hoisting machine. The elevator car is moved in the elevator hoistway e.g. with suspension ropes traveling via the traction sheave of the hoisting machine of the elevator. The elevator car and the counterweight are suspended on different sides of the traction sheave such that their weight difference produces a force difference acting on the traction sheave, which force difference in turn affects the magnitude of the torque needed from the elevator motor when driving the elevator. With a balanced load the torque requirement of the elevator motor is at its minimum, and the torque requirement increases when loading the elevator car to be either heavier than the balanced load or lighter than the balanced load. The torque requirement of the elevator motor incorporated in an elevator system without counterweight, on the other hand, is proportional to the type of elevator system with counterweight in which the elevator car is loaded to be heavier than a balanced load.

When the torque requirement of the elevator motor increases, the current of the elevator motor increases. The increase in current, on the other hand, increases the loading exerted on the elevator motor and also on e.g. the frequency converter supplying power to the elevator motor. When the current increases the copper losses of the elevator motor increase; likewise, the current of the solid-state switches, such as IGBT transistors, of the frequency converter increases when the current of the elevator motor increases.

When dimensioning the frequency converter and the elevator motor, the aim is to select the values for maximum permitted loading to be as close as possible to the value set by the maximum transport capacity required of the elevator. This is because overdimensioning of the frequency converter and of the elevator motor would incur extra costs; additionally, in this case the size of the frequency converter, of the elevator motor and also of any cooling apparatus possibly needed would grow to be unnecessarily large, which would hamper the placement of these devices e.g. in the elevator hoistway.

Experts subordinate to, and under the direction of, the applicant are thus continuously striving to develop control methods and operating methods of an elevator motor for improving the performance of both the elevator motor and of the power supply apparatus of the elevator motor.

SUMMARY OF THE INVENTION

The aim of the invention is to disclose an elevator system having a motor drive with which the elevator can be driven closer on average than in prior art to the upper limit for performance of the motor drive that is set by the maximum permitted loading of the motor drive. To achieve this aim the invention discloses an elevator system according to claim 1. The preferred embodiments of the invention are described in the non-independent claims. Some inventive embodiments and inventive combinations of the various embodiments are also presented in the descriptive section and in the drawings of the present application.

The invention relates to an elevator system, which comprises an elevator car and also a motor drive for moving the elevator car according to a movement profile to be determined for the movement of the elevator car. The loading of the aforementioned motor drive is arranged to be limited to the limit value for the maximum permitted loading by changing the value of a movement magnitude of the elevator car in the movement profile of the elevator car when the position of the elevator car changes. In a preferred embodiment of the invention the loading of the motor drive is arranged to be limited to the limit value for the maximum permitted loading by changing the value of a movement magnitude of the elevator car in the movement profile of the elevator car when the position of the elevator car and/or the load of the elevator car changes. The movement magnitude of the elevator car referred to in the invention is preferably the maximum speed of the elevator car, the acceleration of the elevator car and/or the deceleration of the elevator car. Acceleration refers preferably to the maximum instantaneous acceleration according to the movement profile of the elevator car; correspondingly, deceleration refers preferably to the maximum instantaneous deceleration according to the movement profile of the elevator car.

In a preferred embodiment of the invention the aforementioned movement magnitude of the elevator car is preferably the acceleration of the elevator car and/or the deceleration of the elevator car. The loading of the motor drive is in this case arranged to be limited preferably to the limit value for the maximum permitted loading by reducing the acceleration of the elevator car and/or the deceleration of the elevator car in the movement profile of the elevator car in relation to the acceleration/deceleration of the elevator car when situated higher up.

In a preferred embodiment of the invention the aforementioned movement magnitude of the elevator car is the maximum speed of the elevator car. The loading of the motor drive is in this case arranged to be limited preferably to the limit value for the maximum permitted loading by reducing the maximum speed of the elevator car in the movement profile of the elevator car in relation to the maximum speed of the elevator car when situated higher up.

In a preferred embodiment of the invention the elevator system comprises a counterweight. In a preferred embodiment of the invention the loading of the motor drive is in this case arranged to be limited to the limit value for the maximum permitted loading by reducing the acceleration of the elevator car and/or the deceleration of the elevator car in the movement profile of the elevator car, when loaded to be heavier than the balanced load, in relation to the acceleration/deceleration of the elevator car when situated higher up and loaded in a corresponding manner. The loading of the motor drive is further arranged to be limited preferably to the limit value for the maximum permitted loading by reducing the acceleration of the elevator car and/or the deceleration of the elevator car in the movement profile of the elevator car, when loaded to be lighter than the balanced load, in relation to the acceleration/deceleration of the elevator car when situated lower down and loaded in a corresponding manner. A balanced load refers to the type of load of an elevator car, with which the loaded elevator car weighs essentially the same amount as the counterweight.

In a preferred embodiment of the invention the loading of the motor drive is, in connection with an elevator system with counterweight, arranged to be limited to the limit value for the maximum permitted loading by reducing the maximum speed of the elevator car in the movement profile of the elevator car, when loaded to be heavier than the balanced load, in relation to the maximum speed of the elevator car when situated higher up and loaded in a corresponding manner. The loading of the motor drive is further arranged to be limited preferably to the limit value for the maximum permitted loading by reducing the maximum speed of the elevator car in the movement profile of the elevator car, when loaded to be lighter than the balanced load, in relation to the maximum speed of the elevator car when situated lower down and loaded in a corresponding manner.

The aforementioned motor drive is preferably an electric drive of an elevator. The electric drive of an elevator preferably comprises an alternating current motor and also a frequency converter for supplying current to the alternating current motor.

The force acting in the elevator ropes disposed between the traction sheave and the elevator car, as also the force acting in the elevator ropes disposed between the traction sheave and the counterweight, changes when the position of the elevator car changes. This is because the weight of the elevator ropes suspended in the top part of the elevator hoistway and disposed between the traction sheave/rope pulley and the elevator car decreases when the elevator car moves upwards and increases when the elevator car moves downwards. In a corresponding manner the weight of the elevator ropes suspended in the top part of the elevator hoistway and disposed between the traction sheave/rope pulley and the counterweight increases when the elevator car moves upwards and decreases when the elevator car moves downwards. In this case, when the loading of the motor drive is limited according to the invention to the limit value for the maximum permitted loading by changing the value of a movement magnitude of the elevator car in the movement profile of the elevator car when the position of the elevator car changes, the elevator can be driven with the motor drive closer than in prior art to the upper limit for performance that is set by the maximum permitted loading of the motor drive. The torque requirement of the elevator motor and thereby the current of the electric drive of the elevator can e.g. be limited by decreasing the acceleration according to the movement profile of the elevator car when the elevator car is situated at such a point of the elevator hoistway where the torque requirement during acceleration of the elevator motor would otherwise grow to be unnecessarily large. On the other hand, the maximum speed of the elevator car according to the movement profile of the elevator car can also be increased e.g. by increasing the field weakening of the elevator motor when the elevator car is situated at such a point of the elevator hoistway where the torque requirement of the elevator motor and thereby the current requirement of the electric drive of the elevator are sufficiently small to allow supplying extra field weakening current to the elevator motor. In this way the transport capacity of the elevator can be increased and also e.g. the door-to-door time of the elevator can be shortened.

The change produced in the torque requirement of the elevator motor by the change in position of the elevator car is particularly large in those type of elevator systems in which the elevator assembly is implemented without a compensating rope, which otherwise can be used for reducing the change in the torque requirement of the elevator motor produced by a change in the weight of the elevator ropes. Other problems, however, in addition to the cost impacts, are caused in the elevator assembly by the addition of one or more compensating ropes: the compensating ropes increase the total mass to be suspended in the elevator hoistway; in addition, the compensating ropes might start to sway as a result of an earthquake and also, particularly in high-rise buildings, from the effect of wind.

The aforementioned summary, as well as the additional features and advantages of the invention presented below, will be better understood by the aid of the following description of some embodiments, said description not limiting the scope of application of the invention.

BRIEF EXPLANATION OF THE FIGURES

In the following, the invention will be described in more detail by the aid of some examples of its embodiments with reference to the attached figures, wherein.

MORE DETAILED DESCRIPTION OF PREFERRED EMBODIMENTS OF THE INVENTION

Certain features to be presented, such as changes in the speed/acceleration/deceleration and current of the elevator car can be exaggerated in the figures in order to clarify the basic idea of the invention.

Figure 1:
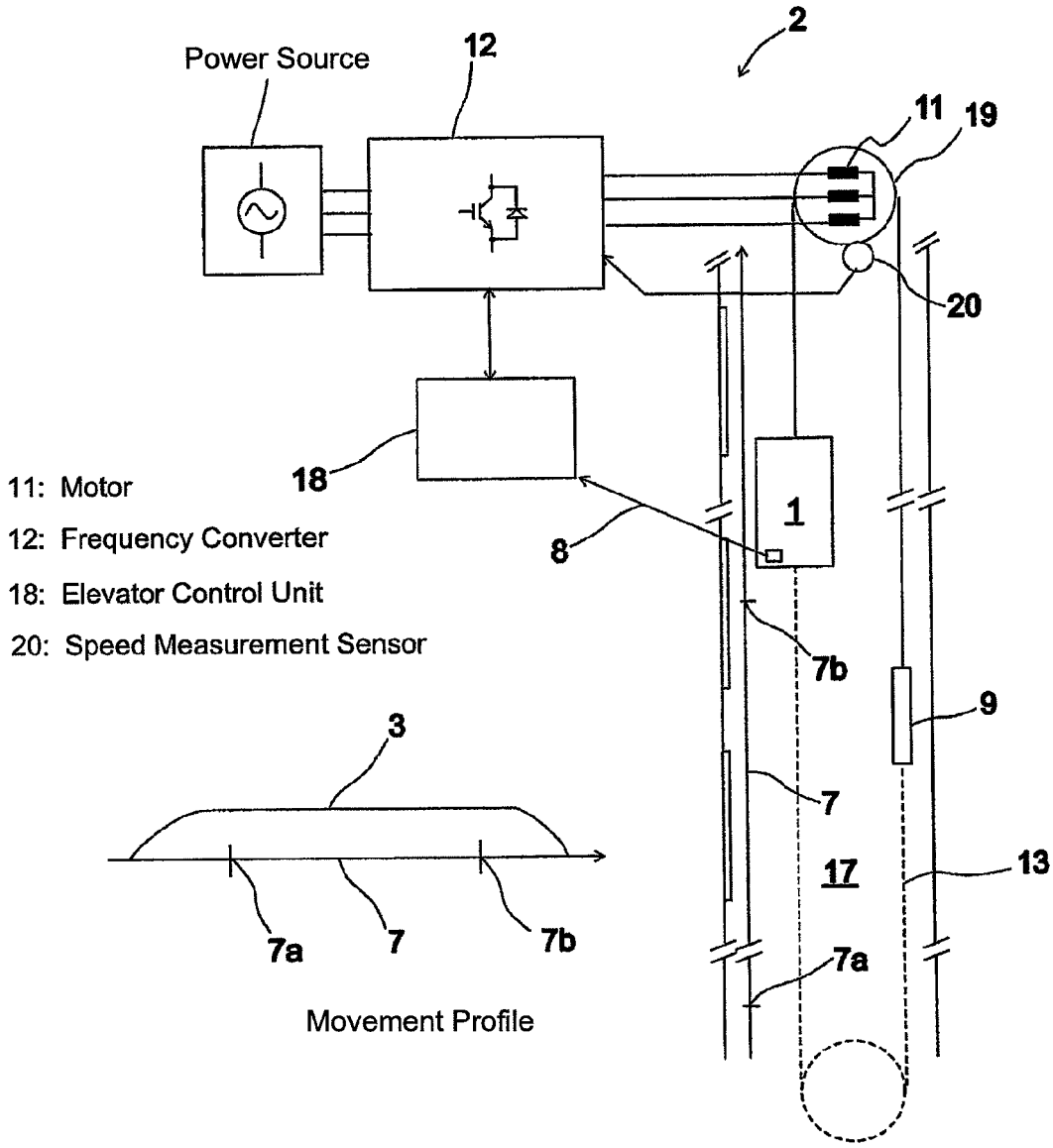
FIG. 1 presents an elevator system according to the invention, as a block diagram

The elevator system of FIG. 1 comprises an elevator car 1 and also an electric drive 2 for moving the elevator car in the elevator hoistway 17 according to a movement profile 3 of the elevator car, which profile is formed by the elevator control unit 18. The electric drive 2 comprises a hoisting machine 19 disposed in the top part of the elevator hoistway 17, which hoisting machine comprises an alternating current motor 11 as the power producing part. In addition, the electric drive 2 comprises a frequency converter 12 for supplying variable-amplitude and variable-frequency current to the alternating current motor 11.

The elevator car 1 is suspended in the elevator hoistway 17 with suspension means, such as ropes, a belt or corresponding, passing via the traction sheave of the hoisting machine 19 (in the following the term "elevator rope" will be used generally to refer to said suspension means). The hoisting machine 19 is, in this embodiment of the invention, fixed to the guide rail (not in figure) of the elevator car, in a space between the guide rail and the wall of the elevator hoistway 17. The hoisting machine 19 could, however, also be fixed to a machine bedplate, and the hoisting machine could also be disposed elsewhere in the elevator hoistway or in a machine room instead of in the elevator hoistway. In this embodiment of the invention the elevator assembly is implemented without a compensating rope; the elevator assembly could, however, also comprise one or more compensating ropes, which in this case could be fitted into the elevator assembly e.g. in the manner marked in FIG. 1 with a dashed line 13.

The elevator control unit 18 sends the movement profile 3 of the elevator car it has formed to the frequency converter 12 via a data transfer bus between the elevator control unit 18 and the frequency converter 12. The frequency converter 12 measures the speed of rotation of the rotor of the elevator motor 11 with a speed measurement sensor 20 and sets the torque of the elevator car by adjusting the current running in the elevator motor such that the movement of the rotor of the elevator car, and thereby the movement of the elevator car, approaches the aforementioned movement profile 3 of the elevator car.

Figure 3A:
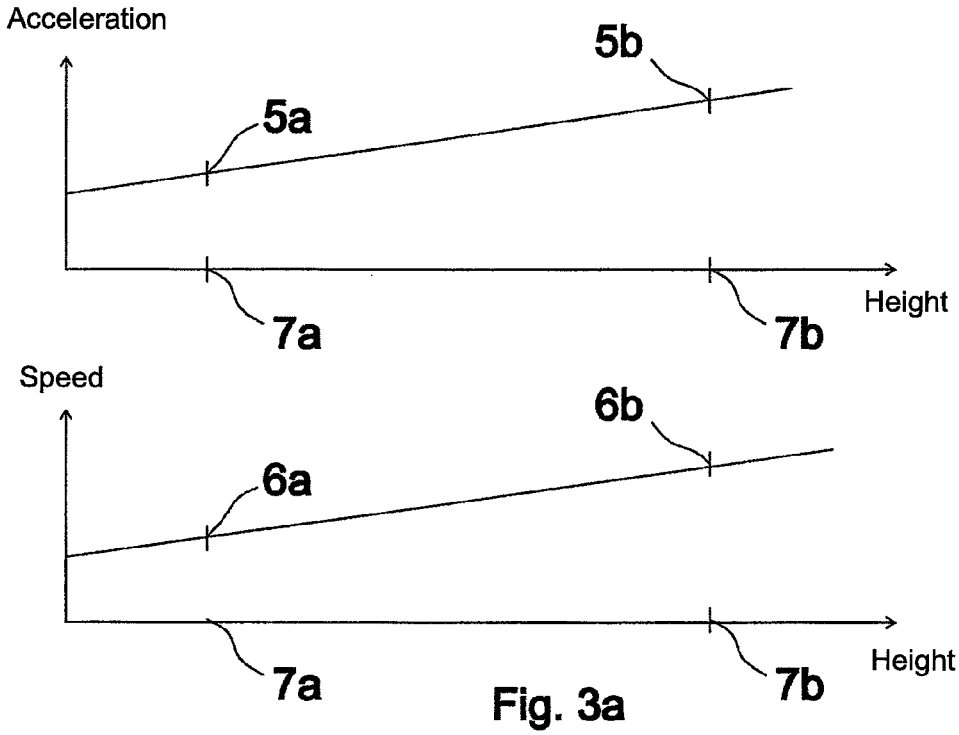
FIGS. 3A and 3B present some adaptable movement magnitudes of a movement profile of an elevator car according to the invention

The elevator control unit 18 determines the position 7 of the elevator car 1 in the elevator hoistway 17. The determination of the position can be implemented e.g. by integrating the speed of rotation of the rotor of the elevator motor 11; the position can also be determined e.g. by integrating the speed data/acceleration data of the elevator car expressed by an acceleration sensor or speed sensor fitted in connection with the elevator car 1. The determination of the position 7 of the elevator car 1 can also be further adjusted at the point of the door zones 21. The elevator control unit 18 determines the movement profile 3 of the elevator car by changing the value for the acceleration/deceleration 5*a*, 5*b* of the elevator car and also for the maximum speed 6*a*, 6*b* of the elevator car in the movement profile of the elevator car in the manner presented in FIGS. 3A, 3B when the position 7 of the elevator car 1 changes. FIG. 3A presents a situation in which the elevator car 1 is loaded to be essentially heavier than a balanced load. Information about the load 8 of the elevator car is obtained from the load-weighing sensor in the elevator car, but the load 8 of the elevator car could also be estimated e.g. on the basis of the currents of the elevator motor. FIG. 3A presents the value for the acceleration/deceleration of the elevator car to be used in the movement profile 3 of the elevator car when the position 7 of the elevator car in the elevator hoistway 17 changes from down upwards. In a first embodiment of the invention the elevator control unit 18 limits the loading of the electric drive 2 to the limit value for the maximum permitted loading by selecting the acceleration and/or deceleration 5*a* of the elevator car to be used in the movement profile 3 of the elevator car when lower down in the elevator hoistway, e.g. at the point 7*a*, to be smaller than the acceleration and/or deceleration 5*b* of the elevator car to be used when higher up in the elevator hoistway, e.g. at the point 7*b*. In a second embodiment of the invention the elevator control unit 18 also selects the maximum speed of the elevator car to be used in the movement profile 3 of the elevator car such that a smaller maximum speed 6*a* is used when lower down in the elevator hoistway, e.g. at the point 7*a*, than the maximum speed 6*b* of the elevator car to be used when higher up in the elevator hoistway, e.g. at the point 7*b*. Increasing the maximum speed of the elevator car 1 in the elevator hoistway 17 from down upwards enables the door-to-door time of the elevator car to be shortened and at the same time also the transport capacity of the elevator increases. This type of control method is advantageous e.g. in freight elevators, in which the effects of a change in the maximum speed on the driving style of the elevator does not necessarily need to be taken into account in the same way as in passenger elevators. This type of control method can be advantageous also e.g. when driving an empty elevator car, intended for transporting passengers,.

Figure 3B:
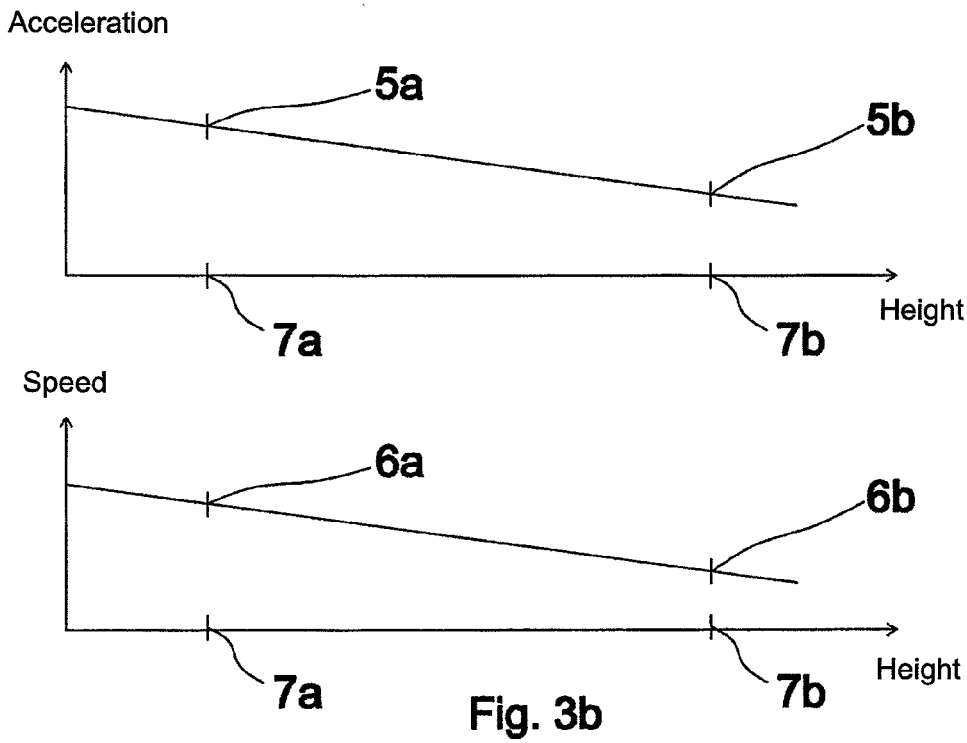

In the situation according to FIG. 3B, the elevator car 1 is loaded to be essentially lighter than a balanced load. In a first embodiment of the invention the elevator control unit 18 limits the loading of the electric drive 2 to the limit value for the maximum permitted loading by selecting the acceleration and/or deceleration 5*a* of the elevator car to be used in the movement profile 3 of the elevator car when lower down in the elevator hoistway, e.g. at the point 7*a*, to be greater than the acceleration and/or deceleration 5*b* of the elevator car to be used when higher up in the elevator hoistway, e.g. at the point 7*b*. In a second embodiment of the invention the elevator control unit 18 also selects the maximum speed of the elevator car to be used in the movement profile 3 of the elevator car such that a greater maximum speed 6*a* is used when lower down in the elevator hoistway, e.g. at the point 7*a*, than maximum speed 6*b* of the elevator car to be used when higher up in the elevator hoistway, e.g. at the point 7*b*. Increasing the maximum speed of the elevator car 1 in the elevator hoistway 17 from down upwards in this case enables the door-to-door time of the elevator car to be shortened and at the same time also the transport capacity of the elevator increases.

Figure 2:
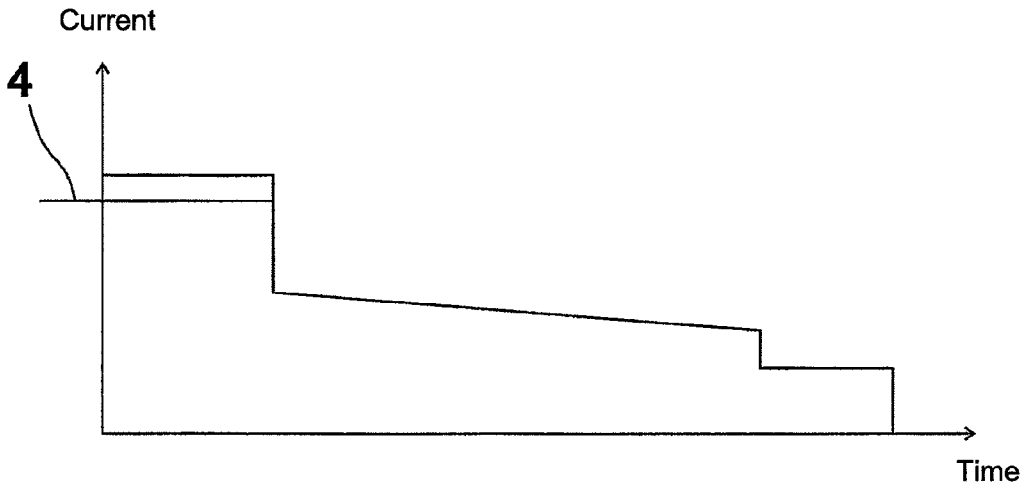
FIG. 2 presents the current of an elevator motor driving at constant speed and constant acceleration according to prior art

By limiting the acceleration and/or deceleration 5*a*, 5*b* in the manner presented in FIGS. 3A, 3B, the elevator can be driven with the electric drive closer than in prior art to the upper limit for performance that is set by the maximum permitted loading of the electric drive. This is because the weight of the elevator ropes suspended in the top part of the elevator hoistway and disposed between the traction sheave of the hoisting machine 19 and the elevator car 1 decreases when the elevator car 1 moves upwards and increases when the elevator car 1 moves downwards. In a corresponding manner the weight of the elevator ropes disposed between the traction sheave of the hoisting machine 19 and the counterweight 9 increases when the elevator car 1 moves upwards and decreases when the elevator car 1 moves downwards. To clarify the matter, FIG. 2 presents the current of an elevator motor moving an elevator car at constant speed and constant acceleration according to prior art, described in relation to time. A permanent-magnet synchronous motor is used here as the elevator motor. In the situation of FIG. 2 an essentially fully-loaded elevator car drives in the elevator hoistway from down upwards, accelerating first to maximum speed, after which the elevator car drives for a certain time at maximum speed, after which the elevator car decelerates, stopping at the destination floor. In this case the elevator motor and thereby also the current of the frequency converter supplying the elevator motor is at its maximum during the initial acceleration; during constant speed the current gradually decreases owing to the changes of the weight of the aforementioned elevator ropes disposed between the elevator car and traction sheave as well as between the counterweight and the traction sheave. The magnitude of the current varies in essentially the same way in a situation in which an essentially empty elevator car drives from up to down in the elevator hoistway, accelerating first to maximum speed, after which the elevator car drives for a certain time at maximum speed, after which the elevator car decelerates, stopping at the destination floor.

Figure 4A:
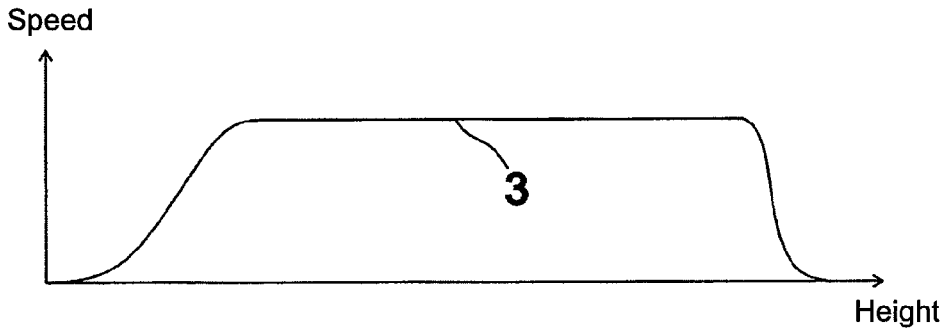
FIGS. 4A-4D present some movement profiles of an elevator car according to the invention and also the motor currents according to these movement profiles
Figure 4B:
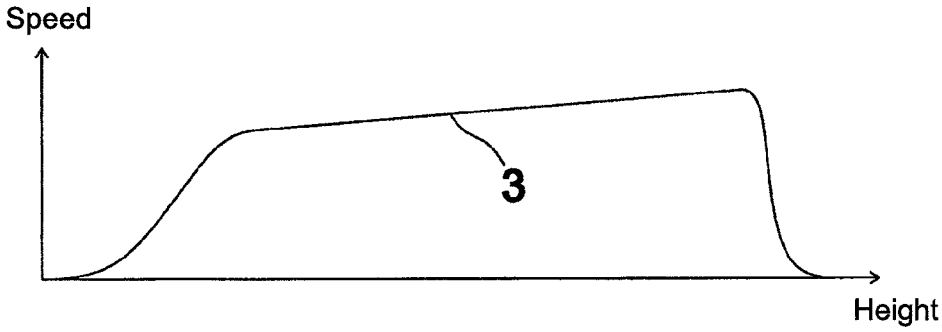
Figure 4C:
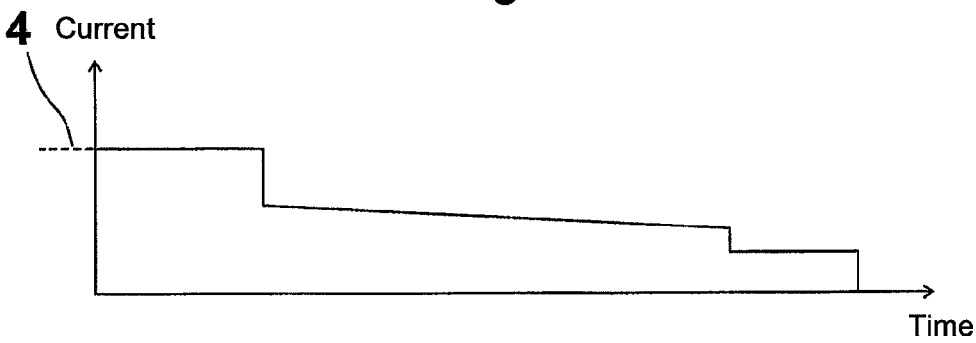
Figure 4D:
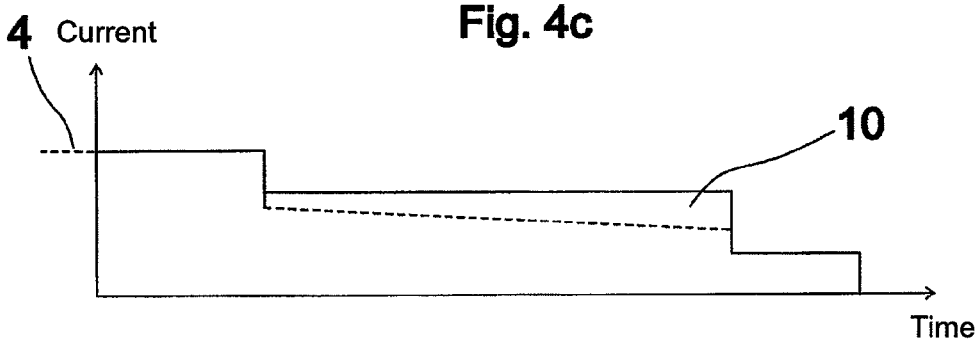

FIGS. 4A and 4B present first the graphs 3 according to the invention of the movement profile of an elevator car in relation to time, and FIGS. 4C, 4D present the corresponding currents of the elevator car. FIG. 4A presents the speed profile 3 of the elevator car according to the first embodiment of the invention, in which speed profile only the acceleration/deceleration of the elevator car is changed during a run with the elevator. In this case the elevator car starts moving from the bottom part of the hoistway with limited acceleration and stops in the top part of the hoistway with a deceleration that is greater than this. FIG. 4B presents the speed profile of the elevator car according to the second embodiment of the invention, in which speed profile also the maximum speed of the elevator car, in addition to the acceleration/deceleration of the elevator car, is changed during a run with the elevator, for increasing the transport capacity of the elevator and for shortening the door-to-door time of the elevator. The graphs of FIGS. 4A-4D are presented in the loading state according to FIG. 2, so that the motor currents can be compared to each other. Marked in FIG. 4D is a field weakening current 10, which is supplied to the permanent-magnet synchronous motor moving the elevator car for weakening the rotor excitation. By weakening the rotor excitation the source voltage induced in the stator winding by the permanent magnets decreases, which enables an increase in the maximum speed of the elevator motor. As presented in FIG. 4D, the amount of field weakening is increased in stages when the elevator car moves from down upwards.

By comparing FIGS. 4A-4D and FIG. 2 it can be observed that by setting one or more movement magnitudes of the elevator car in the movement profile of the elevator car in the manner presented in the invention, the motor current can be limited to the limit value 4 for maximum permitted current for the whole time of a run with the elevator.

The aforementioned limit value 4 for maximum permitted current of the elevator motor and/or of the frequency converter can be determined e.g. on the basis of the copper losses of the motor or on the basis of the current endurance of the IGBT transistors of the frequency converter. Also the cooling of the elevator motor and/or of the frequency converter can affect the limit value for maximum permitted current such that by enhancing the cooling the limit value for maximum permitted current can be increased.

The invention is not only limited to be applied to the embodiments described above, but instead many variations are possible within the scope of the inventive concept defined by the claims below.

The invention claimed is:

1. Elevator system, which comprises:

an elevator car;

a counterweight;

a motor drive for moving the elevator car according to a movement profile to be determined for the movement of the elevator car;

wherein the loading of the aforementioned motor drive is arranged to be limited to the limit value for the maximum permitted loading by reducing the maximum instantaneous acceleration of the elevator car or the maximum instantaneous deceleration of the elevator car in the movement profile of the elevator car, when loaded to be heavier than a balanced load, in relation to the maximum instantaneous acceleration/maximum instantaneous deceleration of the elevator car when situated higher up and loaded in a corresponding manner, and the loading of the aforementioned motor drive is further arranged to be limited to the limit value for the maximum permitted loading by reducing the maximum instantaneous acceleration of the elevator car or the maximum instantaneous deceleration of the elevator car in the movement profile of the elevator car, when loaded to be lighter than the balanced load, in relation to the maximum instantaneous acceleration/maximum instantaneous deceleration of the elevator car when situated lower down and loaded in a corresponding manner.

2. Elevator system according to claim 1, wherein the loading of the motor drive is arranged to be limited to the limit value for the maximum permitted loading by changing the value of a movement magnitude of the elevator car in the movement profile of the elevator car when the load of the elevator car changes.

3. Elevator system according to claim 1, wherein the aforementioned movement magnitude of the elevator car is the acceleration of the elevator car or the deceleration of the elevator car.

4. Elevator system according to claim 3, wherein the loading of the motor drive is arranged to be limited to the limit value for the maximum permitted loading by reducing the acceleration of the elevator car or the deceleration of the elevator car in the movement profile of the elevator car in relation to the acceleration/deceleration of the elevator car when situated higher up.

5. Elevator system according to claim 1, wherein the movement magnitude of the elevator car is the maximum speed of the elevator car.

6. Elevator system according to claim 5, wherein the loading of the motor drive is arranged to be limited to the limit value for the maximum permitted loading by reducing the maximum speed of the elevator car in the movement profile of the elevator car in relation to the maximum speed of the elevator car when situated higher up.

7. Elevator system according to claim 1, wherein the loading of the motor drive is arranged to be limited to the limit value for the maximum permitted loading by reducing the acceleration of the elevator car or the deceleration of the elevator car in the movement profile of the elevator car, when loaded to be heavier than the balanced load, in relation to the acceleration/deceleration of the elevator car when situated higher up and loaded in a corresponding manner.

8. Elevator system according to claim 1, wherein the loading of the motor drive is arranged to be limited to the limit value for the maximum permitted loading by reducing the acceleration of the elevator car or the deceleration of the elevator car in the movement profile of the elevator car, when loaded to be lighter than the balanced load or when empty, in relation to the acceleration/deceleration of the elevator car when situated lower down and loaded in a corresponding manner.

9. Elevator system according to claim 1, wherein the loading of the motor drive is arranged to be limited to the limit value for the maximum permitted loading by reducing the maximum speed of the elevator car in the movement profile of the elevator car, when loaded to be heavier than the balanced load, in relation to the maximum speed of the elevator car when situated higher up and loaded in a corresponding manner.

10. Elevator system according to claim 1, wherein the loading of the motor drive is arranged to be limited to the limit value for the maximum permitted loading by reducing the maximum speed of the elevator car in the movement profile of the elevator car, when loaded to be lighter than the balanced load or when empty, in relation to the maximum speed of the elevator car when situated lower down and loaded in a corresponding manner.

11. Elevator system according to claim 5, wherein the motor drive is arranged to increase the field weakening of the elevator motor for increasing the maximum speed of the elevator car.

12. Elevator system according to claim 1, wherein the aforementioned motor drive is an electric drive of an elevator.

13. Elevator system according to claim 12, wherein the electric drive of the elevator comprises an alternating current motor and a frequency converter for supplying current to the alternating current motor.

14. Elevator system according to claim 1, wherein the elevator is implemented without a compensating rope.

15. Elevator system according to claim 2, wherein the movement magnitude of the elevator car is the acceleration of the elevator car or the deceleration of the elevator car.

16. Elevator system according to claim 2, wherein the movement magnitude of the elevator car is the maximum speed of the elevator car.

17. Elevator system according to claim 3, wherein the movement magnitude of the elevator car is the maximum speed of the elevator car.

18. Elevator system according to claim 4, wherein the movement magnitude of the elevator car is the maximum speed of the elevator car.

* * * * *